US007185600B2

(12) United States Patent
Toussi et al.

(10) Patent No.: US 7,185,600 B2
(45) Date of Patent: Mar. 6, 2007

(54) INFLATABLE KEEL FLOOR CHAMBER FOR INFLATABLE KAYAKS

(75) Inventors: Afshin Toussi, Sartell, MN (US); Claude T. S. Lou, Taipei (TW)

(73) Assignee: Stearns Inc., Sauk Rapids, MN (US)

( * ) Notice: Subject to any disclaimer, the term of this patent is extended or adjusted under 35 U.S.C. 154(b) by 314 days.

(21) Appl. No.: 10/821,398

(22) Filed: Apr. 9, 2004

(65) Prior Publication Data

US 2006/0144313 A1 Jul. 6, 2006

(51) Int. Cl.
*B63B 7/08* (2006.01)
*B63B 35/71* (2006.01)

(52) U.S. Cl. ..... 114/345; 114/347

(58) Field of Classification Search ..... 114/345, 114/347, 354; 5/706–710, 712, 713; 441/40
See application file for complete search history.

(56) References Cited

U.S. PATENT DOCUMENTS

| | | | | |
|---|---|---|---|---|
| 1,555,080 | A | 9/1925 | Scheibert | |
| 1,631,047 | A | 5/1927 | Meyer | |
| 2,873,459 | A | 2/1959 | März | |
| 2,999,253 | A | 9/1961 | Lewis | |
| 3,359,579 | A | 12/1967 | Reffell et al. | |
| 3,935,607 | A | 2/1976 | Cantwell et al. | |
| 4,057,865 | A | 11/1977 | Trautwein | |
| 4,206,933 | A * | 6/1980 | Koch | 280/18 |
| 4,722,292 | A | 2/1988 | Marino et al. | |
| 4,750,446 | A | 6/1988 | Sussman | |
| 4,782,777 | A | 11/1988 | Sussman | |
| 5,046,978 | A | 9/1991 | Howerton | |
| 5,299,524 | A | 4/1994 | Szilagyi | |

(Continued)

FOREIGN PATENT DOCUMENTS

DE 4035333 A1 * 4/1991

OTHER PUBLICATIONS

"West Marine 1999 Power Master Catalog," p. 162 and cover.

(Continued)

*Primary Examiner*—Ajay Vasudeva
(74) *Attorney, Agent, or Firm*—Merchant & Gould, P.C.

(57) ABSTRACT

The inflatable kayak includes an inflatable peripheral structure defining at least one buoyancy chamber having elongated side sections that come together at a fore section and a aft section to form a passenger compartment. An inflatable floor cushion supports a floor of the passenger compartment. The floor cushion includes a top wall, a bottom wall, and at least one side gusset. The surface area of the top wall is less than the surface area of the bottom wall. A plurality of elongated, I-beam baffles extends between the top wall and the bottom wall. Each I-beam baffle has a midpoint, between the fore section and aft section, and an end, wherein the height of at least one I-beams baffle measured from the junction of the top wall to the junction of the bottom wall is greater at the midpoint of the baffle than at the end of the baffle. In another embodiment, the inflatable kayak includes an inflatable floor cushion wherein the distance between at least two I-beam baffles along the top wall is less than the distance between at least two I-beam baffles along the bottom wall.

20 Claims, 15 Drawing Sheets

U.S. PATENT DOCUMENTS

| | | | | |
|---|---|---|---|---|
| 5,304,082 | A | 4/1994 | Wolfe | |
| 5,351,637 | A | 10/1994 | Brenckmann | |
| 5,564,357 | A | 10/1996 | Peterson | |
| D400,843 | S | 11/1998 | Niemier | |
| 5,964,176 | A | 10/1999 | Grunau et al. | |
| 6,065,421 | A | 5/2000 | Haller et al. | |
| D427,561 | S | 7/2000 | Haller et al. | |
| 6,209,476 | B1 | 4/2001 | Maurel et al. | |
| 6,223,678 | B1 | 5/2001 | Haller et al. | |
| D465,447 | S | 11/2002 | Haller | |
| D468,253 | S | 1/2003 | Haller | |
| 6,539,889 | B2 | 4/2003 | Simpson | |
| 2003/0098558 | A1* | 5/2003 | Steiner et al. | 280/28.5 |

OTHER PUBLICATIONS

"ADVENTURE" inflatable boat description, 4 pages, date and manufacturer unknown.

"Adventure Light" inflatable boat description, 2 pages, date and manufacturer unknown.

"Sevylor 2001 Season Catalog," pp. 8-11 and cover.

"Stearns 2003" Catalog, p. 37 and cover.

"Sevylor Canoes & Kayaks 2004 Season Catalog," pp. 8-11 (believed to have been available before Apr. 9, 2004).

"Sevylor Eskimo Touring Kayaks Owner's Manual," 8 pages (available before Apr. 9, 2004).

"Sevylor Boat Specifications," 1 page (believed to have been available before Apr. 9, 2004).

Seven Color Photographs of Sevylor Eskimo Touring Kayak and its components, 8 pages including cover (available before Apr. 9, 2004).

Stearns 2004 Color Catalog, Front cover, pp. 44-48 showing inflatable boats, back cover (available Apr. 28, 2003).

* cited by examiner

INFLATABLE KEEL FLOOR CHAMBER FOR INFLATABLE KAYAKS

BACKGROUND OF THE INVENTION

1. Field of the Invention

This invention relates generally to boats, kayaks and, more particularly, to inflatable kayaks using an inflatable keel floor chamber.

2. Description of the Prior Art

Kayaks have been constructed in a number of different ways, from a variety of materials. Conventional kayaks are characterized as "hard shell" kayaks because they incorporate rigid frames. Hard shell kayaks perform well because their long and slim design allows for superior tracking and speed performance.

Traditionally, kayaks have been constructed from wood. However, kayaks have also been constructed from other materials like molded fiberglass or other rigid plastic materials. These embodiments have allowed kayaks to become lighter and more portable than traditional wood kayaks.

As portable equipment became increasingly desirable, inflatable kayaks were developed. Inflatable kayaks have been available commercially from companies such as Sea Eagle of Port Jefferson, N.Y. and Sevylor, Inc. of Los Angeles, Calif. Other inflatable kayak embodiments are disclosed in U.S. Pat. Nos. 6,065,421 and 6,223,678, and U.S. Design Pat. Nos. D468,253 and D427,561, assigned to Steams, Inc. of St. Cloud, Minn. U.S. Pat. Nos. 6,065,421 and 6,223,678, and U.S. Design Pat. Nos. D468,253 and D427,561 are hereby incorporated by reference.

Inflatable kayaks have been popular due to their overall versatility. However, such kayaks typically have poor tracking capabilities and suffer from poor performance when compared to "hard shell" kayaks. Therefore, kayak users have generally had to choose between performance and portability when selecting a kayak. There is a need for an inflatable kayak with improved tracking.

SUMMARY OF THE INVENTION

The invention to provides an inflatable kayak having a new and improved keeled hull.

The improved keeled hull improves the tracking characteristics of inflatable kayaks while reducing the below waterline drag compared to some prior inflatable kayaks.

In one embodiment, the inflatable kayak includes an inflatable peripheral structure defining at least one buoyancy chamber having elongated side sections that come together at a fore section and a aft section to form a passenger compartment. An inflatable floor cushion supports a floor of the passenger compartment. The floor cushion includes a top wall, a bottom wall, and at least one side gusset. The surface area of the top wall is less than the surface area of the bottom wall. A plurality of elongated, I-beam baffles extends between the top wall and the bottom wall. Each I-beam baffle has a midpoint, between the fore section and aft section, and an end, wherein the height of at least one I-beams baffle measured from the junction of the top wall to the junction of the bottom wall is greater at the midpoint of the baffle than at the end of the baffle.

In another embodiment, the inflatable floor cushion of the kayak includes an inflatable floor cushion having a top wall, a bottom wall, and at least one gusset joining the top wall and bottom wall to define a chamber. A plurality of elongated I-beam baffles is disposed within the cushion. Each I-beam baffle includes a midpoint, between the fore section and aft section, and an end. The distance between at least two I-beam baffles along the top wall is less than the distance between the same two I-beam baffles along the bottom wall.

In a preferred embodiment, the inflatable kayak includes an inflatable peripheral structure defining at least one buoyancy chamber having elongated side sections that come together at a fore section and a aft section to form a passenger compartment. The buoyancy chamber of the peripheral structure includes a first compartment and a second compartment disposed concentrically around the first compartment. An inflatable floor cushion supports a floor of the passenger compartment and includes a top wall, a bottom wall, and at least one side gusset, wherein the surface area of the top wall is at least 5% less than the surface area of the bottom wall. A plurality of elongated, I-beam baffles extends in the longitudinal direction from the fore section of the kayak to the aft section of the kayak, between the top wall and the bottom wall. Each I-beam baffle has a midpoint, between the fore section and aft section, and an end, wherein the height of at least one I-beam baffle measured from the junction of the top wall to the junction of the bottom wall is greater at the midpoint of the baffle than at the end of the baffle. Moreover, the distance between at least two I-beam baffles along the top wall is less than the distance between the same two I-beam baffles along the bottom wall. A cover of flexible material that is less elastic than the material of the peripheral structure and floor cushion is also included. The cover encases the peripheral structure and inflatable floor cushion, forming a substantially inelastic skin against which the peripheral structure and floor cushion can be inflated to form a structure that is more rigid than the peripheral structure and floor cushion. A shell spans beneath the passenger compartment and extends along the lower and outer sides of the peripheral structure and cover to further support the floor cushion and protect the tube and cover.

BRIEF DESCRIPTION OF THE DRAWINGS

Referring to the drawing wherein like numerals represent like parts throughout the several views.

DETAILED DESCRIPTION OF THE PREFERRED EMBODIMENT

Figure 1:
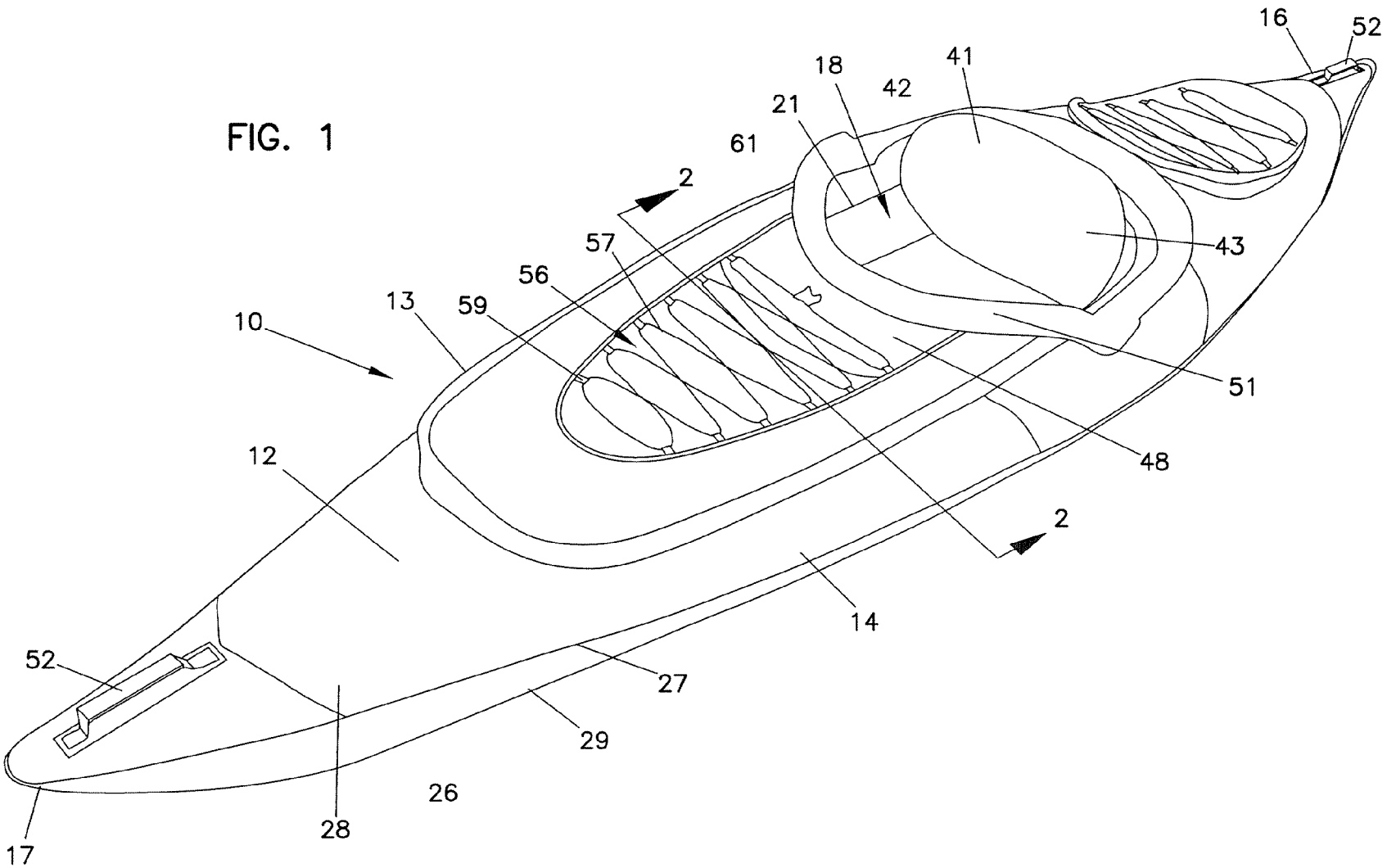
FIG. 1 is an isometric view of one embodiment of an inflatable kayak incorporating the invention.
Figure 2:
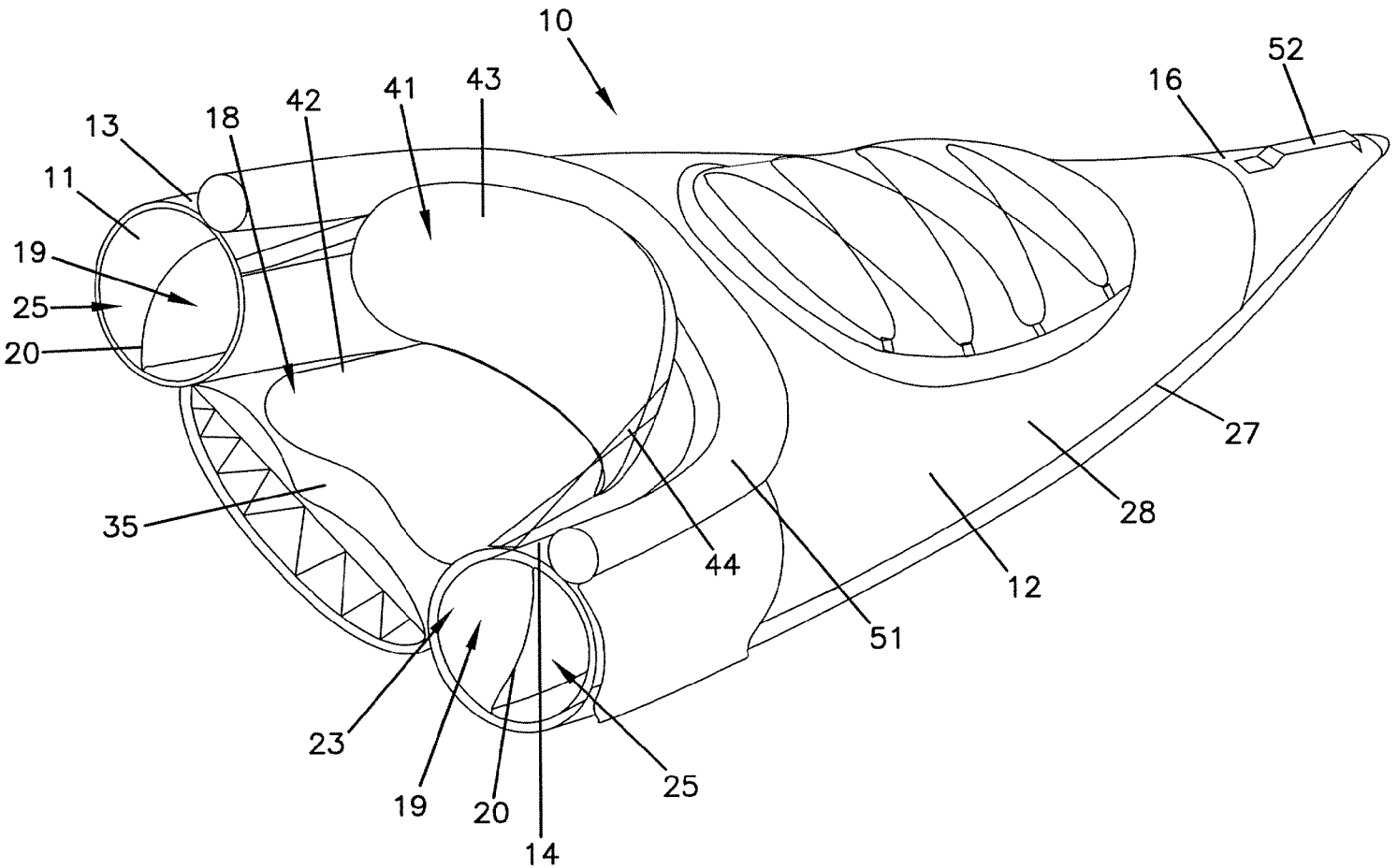
FIG. 2 is a fragmentary isometric view of the embodiment of FIG. 1 taken along line 2—2 of FIG. 1.
Figure 3:
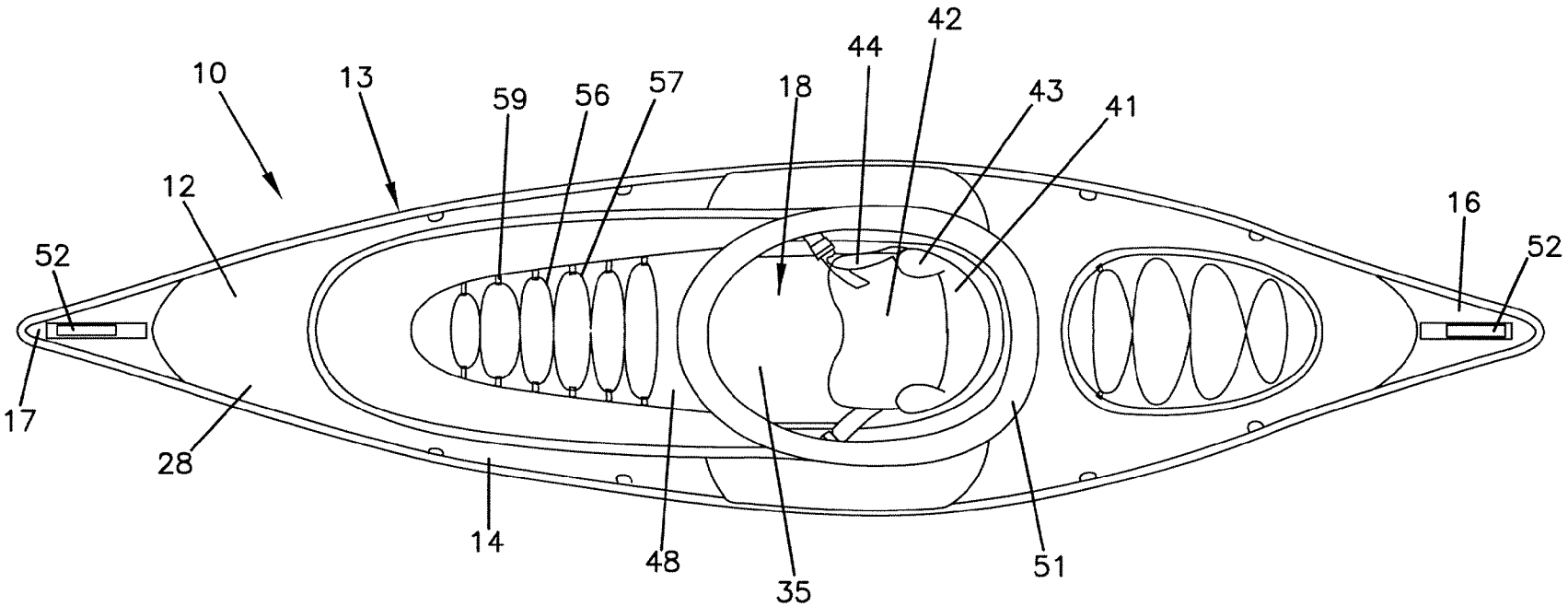
FIG. 3 is a top plain view of the embodiment of FIG. 1.

In FIGS. 1–3, the kayak 10 is shown. The kayak 10 includes a fore section 17 and an aft section 16. A passenger compartment 18 is located between the fore section 17 and the aft section 16.

The performance limitations of inflatable kayaks have been attributed to their floor designs. Many prior-art kayaks utilize an inflatable floor chamber that is thin and flat on both sides. These floor chambers resemble an air mattress with top and bottom sheets having roughly the same surface area. This basic construction performs poorly because it tends to create a "barge effect" during operation. The "barge effect" increases the drag on an inflatable kayak while paddling through water due to the width of the kayak below the water line. Moreover, the floors of certain prior art inflatable kayaks do not effectively support the weight of many users. For example, there is a tendency for the floor shape to dip down under the user's weight. This has the effect of further increasing drag as the user "sinks" into the floor chamber.

The present invention addresses these needs and shortcomings of prior art inflatable kayaks by providing an improved keeled bottom that more closely simulates the improved tracking characteristics of hard shell kayaks. The improved keeled bottom also enhances speed performance by reducing the below waterline drag.

Figure 4:
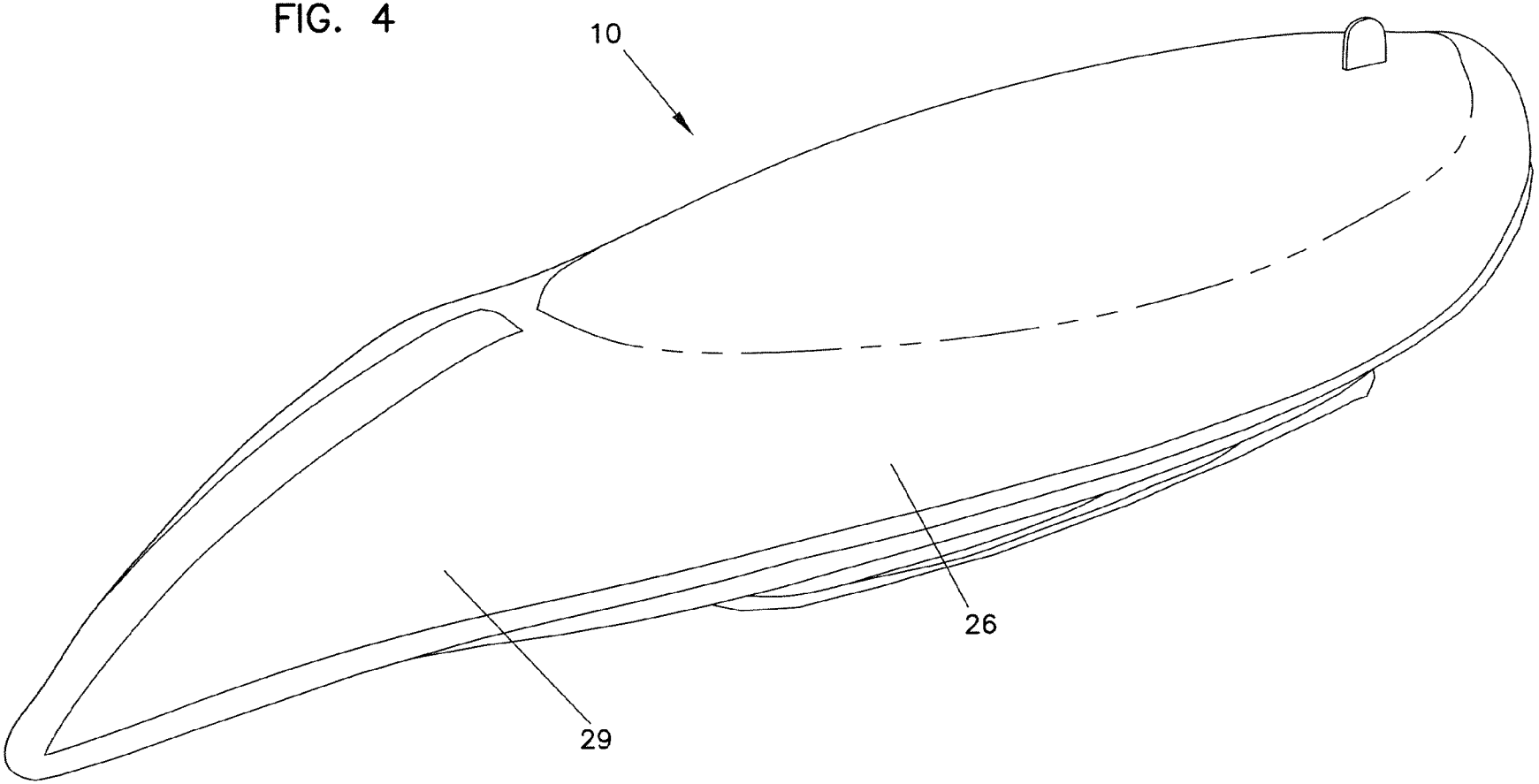
FIG. 4 is a bottom isometric view of the embodiment FIG. 1.
Figure 5:
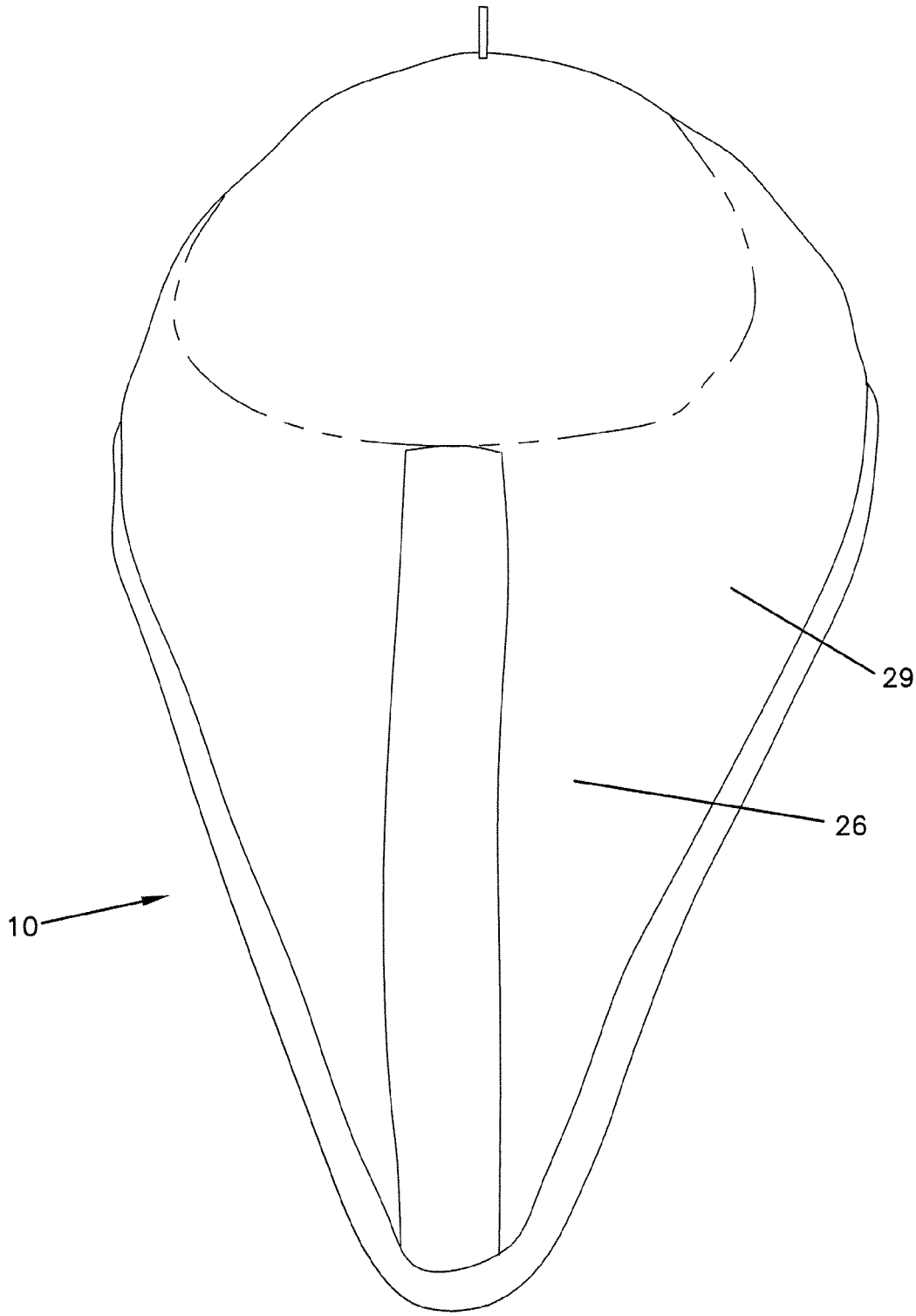
FIG. 5 is a front-bottom isometric view of the inflatable kayak of FIG. 1 incorporating the invention.
Figure 6:
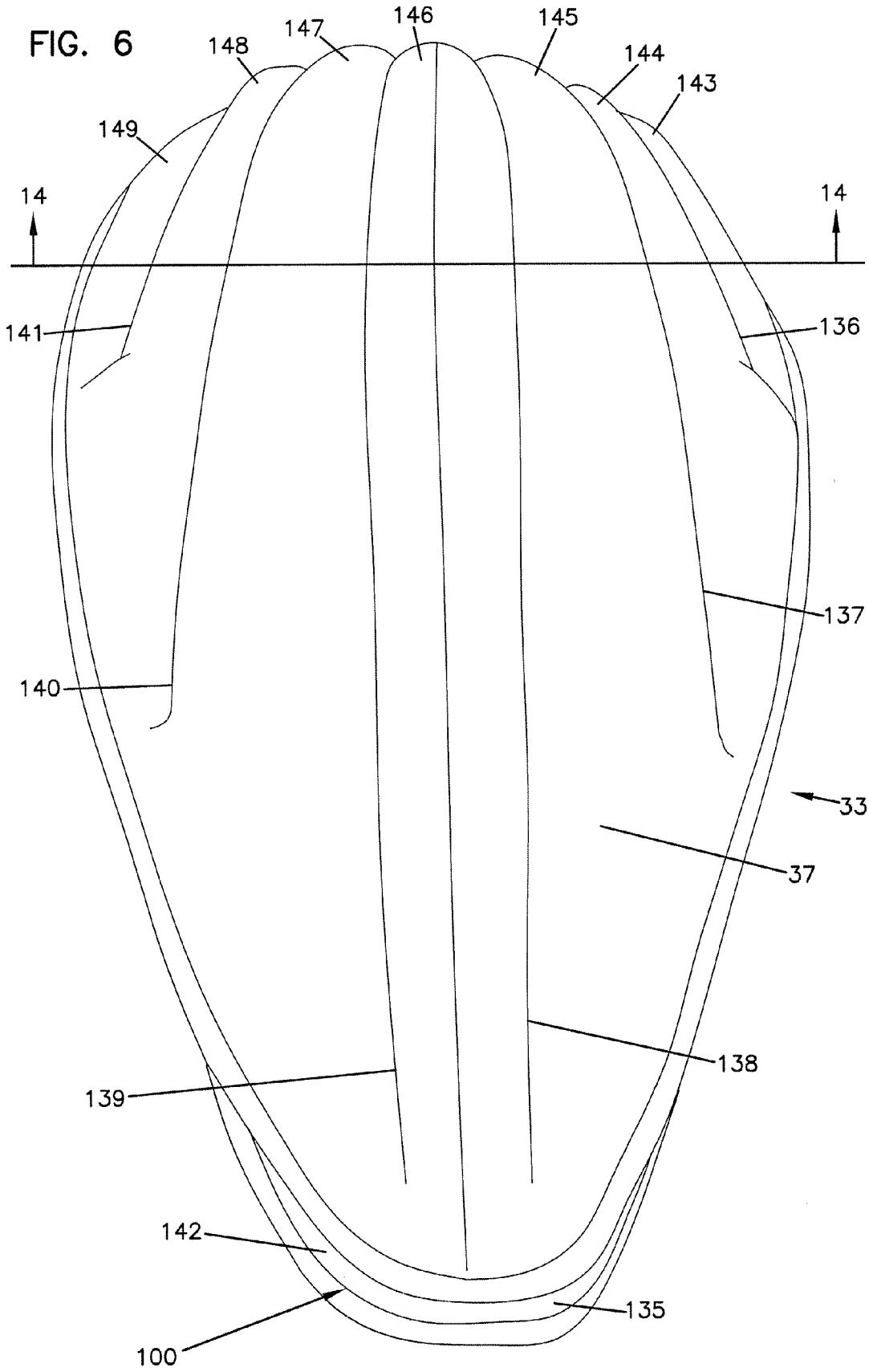
FIG. 6 is a front-bottom isometric view of a floor cushion incorporating the invention.

An improved pneumatically inflated floor cushion 33 supports the floor 35 of the passenger compartment 18. FIGS. 4 and 5 show the location of the floor cushion 33 relative to the peripheral structure 11. The interior of the dashed line of FIGS. 4 and 5 represents the location of the floor cushion 33 beneath the shell 29. The area on the exterior of the dashed line represents the location of the peripheral structure 11 beneath the shell 29.

Figure 13:
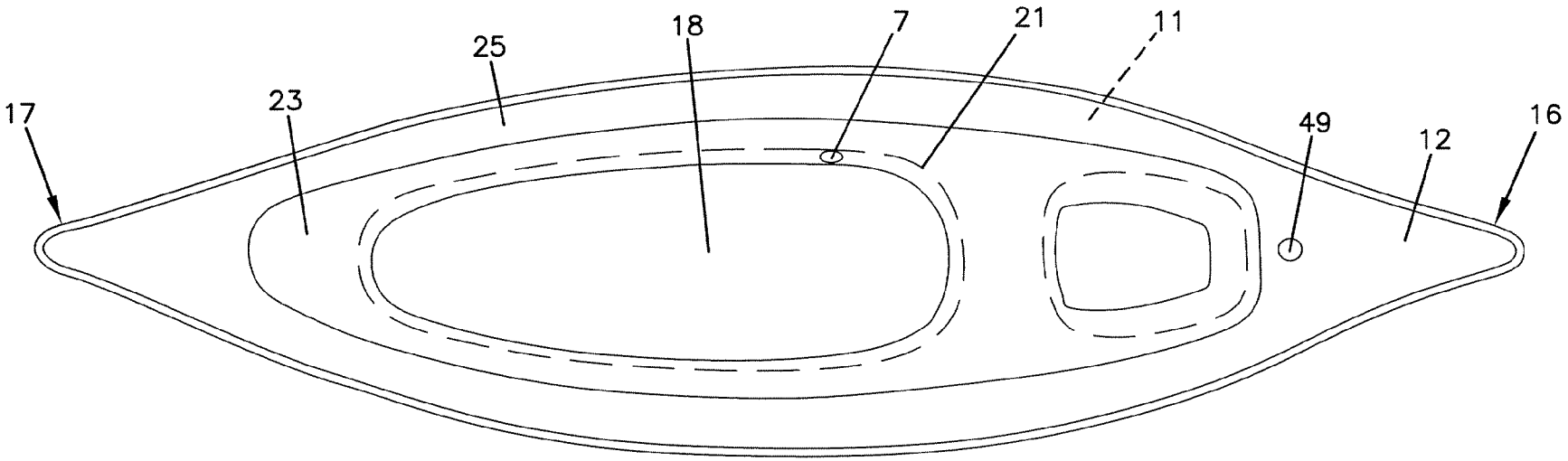
FIG. 13 is a top view of the inflatable kayak of FIG. 1 showing the location of internal baffles incorporating invention.

As shown in FIG. 2, the kayak 10 includes a pneumatically inflatable peripheral structure 11 that is fully encased in a flexible cover 12. The peripheral structure 11 has elongated side sections, including starboard side section 13, and port side section 14 of generally circular cross-section. Sections 13 and 14 come together at the fore section 17 and the aft section 16. The peripheral structure 11 thus defines the open passenger compartment 18 that is surrounded by a continuous buoyancy chamber 19. In a preferred embodiment, divider 20 is disposed within buoyancy chamber 19 and defines inner chamber 23 and outer chamber 25. As shown in FIG. 13, inner chamber 23 is disposed concentrically within the perimeter of outer chamber 25. The fluid in inner chamber 23 is isolated from the fluid in outer chamber 25 in one preferred embodiment. This provides an extra safety feature in that if one of the chambers should lose pressure, the other can remain inflated and have enough buoyancy to keep the kayak 10 afloat.

The peripheral structure 11 and the floor cushion 33 are fabricated of a material such as polyvinyl chloride (PVC) or polyurethane. In a preferred embodiment, the peripheral structure 11 and the floor cushion 33 are constructed of 24 to 30 gauge PVC. Most preferably, the peripheral structure 11 and the floor cushion 33 are constructed of 28 gauge PVC. Alternatively, urethane, neoprene, or other elastomeric polymer materials can be used for the peripheral structure 11 and the floor cushion 33.

The material of the cover 12 is less elastic than the material of the peripheral structure 11. The cover 12 is preferably fabricated of a substantially inelastic material such as nylon. The cover 12 serves as a skin against which the peripheral structure 11 and the floor cushion 33 can be inflated to form a relatively rigid structure. When the cover encases the floor cushion 33 and peripheral structure 11, the resulting assembly is more rigid than either the floor cushion 33 or the peripheral structure 11 alone. In a preferred embodiment, the cover 12 is comprised of 600D to 1200D nylon. In an alternative embodiment, 840 nylon can be used. In another embodiment, cover 12 can be fabricated from polyester, tarpaulin or other reinforced polymers.

The cover 12 wraps around the peripheral structure 11 and is secured by a zipper 21 that extends around the entire inner periphery of the peripheral structure 11. In one preferred embodiment, the two ends of the zipper 21 are located toward the fore section 17 of the kayak 10. The zipper 21 may have two sliders that can be hooked together when the zipper 21 is closed so that it will not be forced open by the pressure within the peripheral structure 11.

Figure 8:
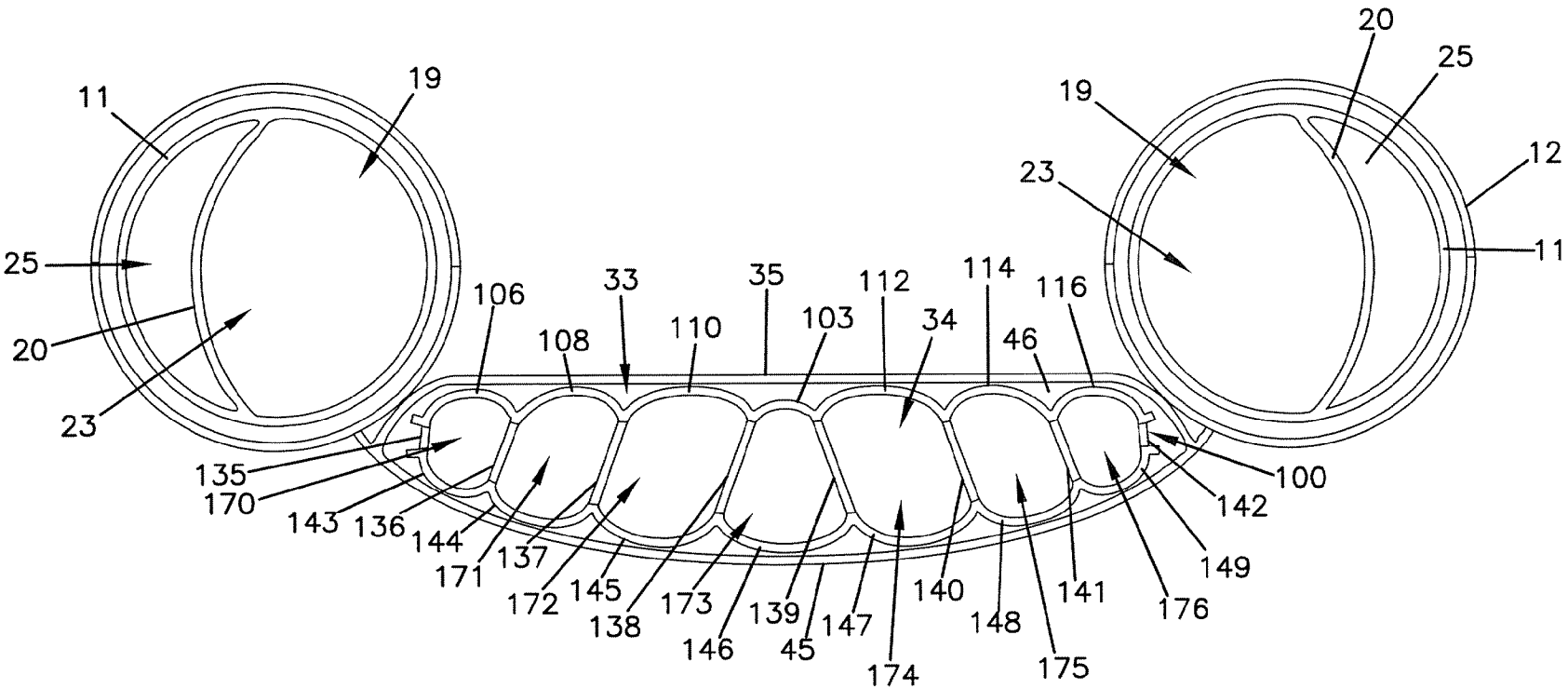
FIG. 8 is a front cross-sectional view of the kayak of FIG. 1 taken along line 2—2 of FIG. 1.
Figure 9:
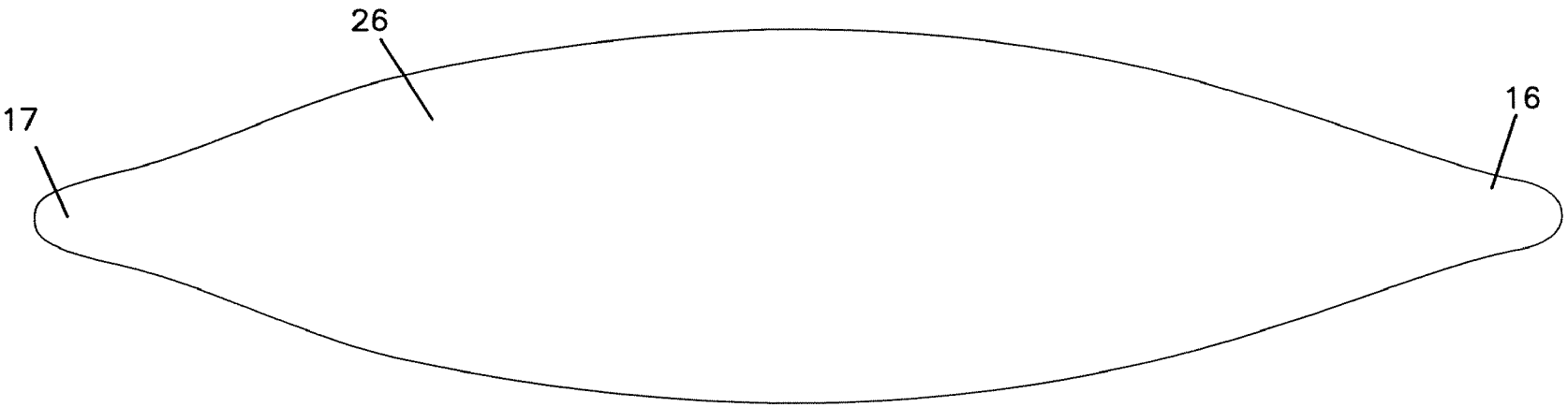
FIG. 9 is a bottom view of the kayak incorporating the invention.

As shown in FIG. 8, the cover 12 also includes a floor 35 and a base 45. A pocket 46 is defined by the region between the floor 35 and the base 45. The floor cushion 33 is disposed within the pocket 46. The floor cushion 33 can be completely sealed within the pocket 46 or alternatively, the floor cushion 33 can be removable from pocket 46 through at least one opening. The opening may be sealed with a variety of reversible closures including a hook and loop fastener or a zipper.

Figure 7:
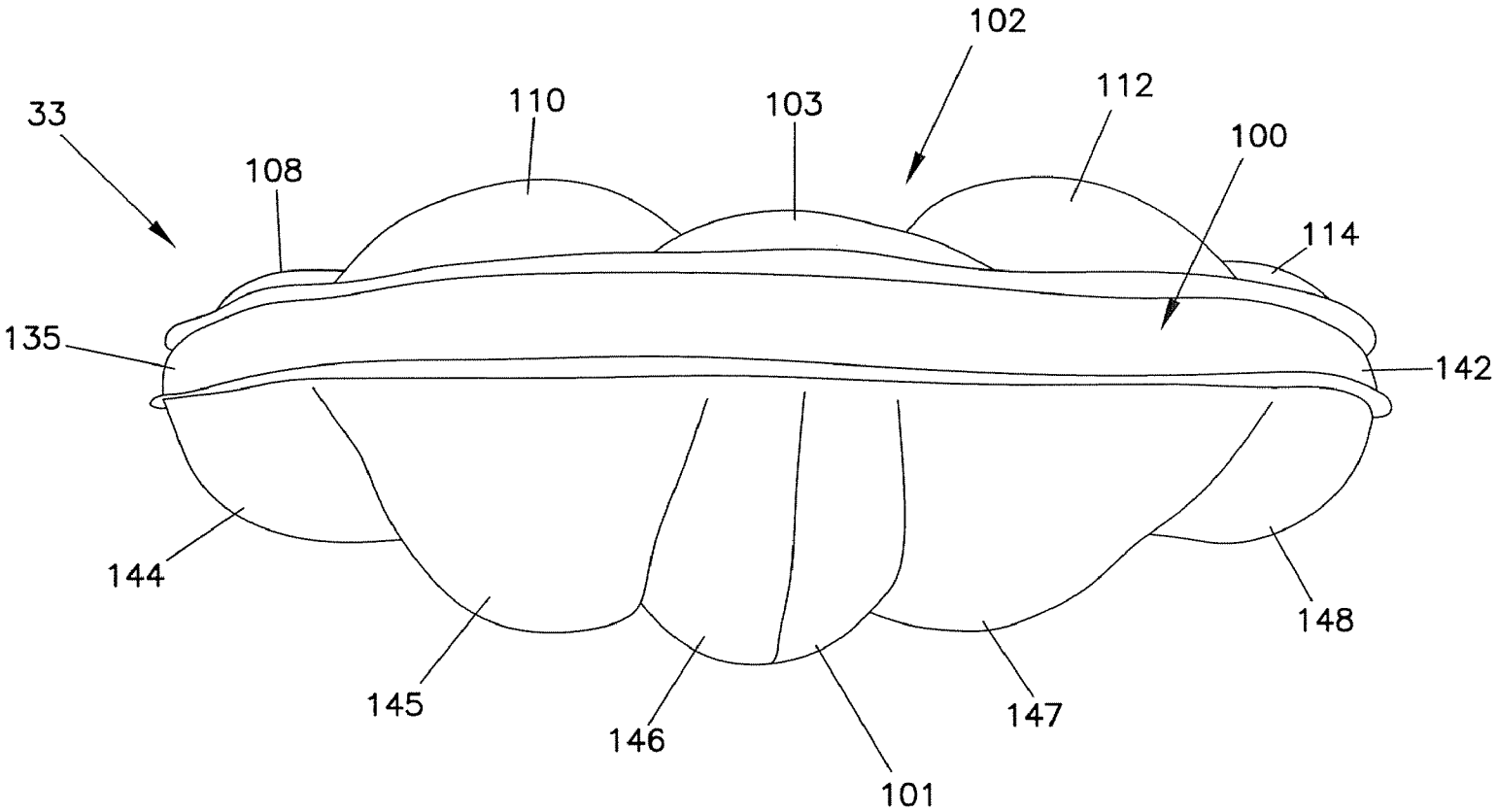
FIG. 7 is a front view of the floor cushion incorporating the invention.
Figure 10:
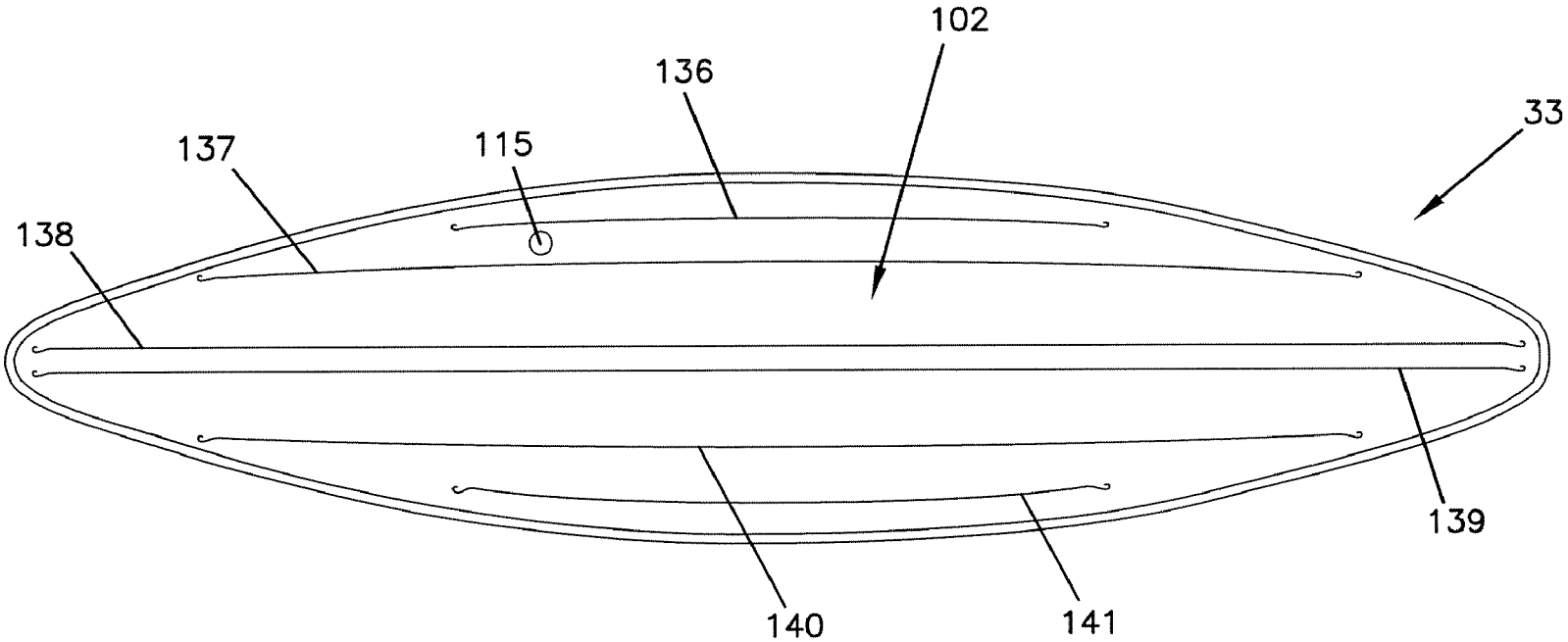
FIG. 10 is a top view of a floor cushion incorporating the invention.
Figure 11:
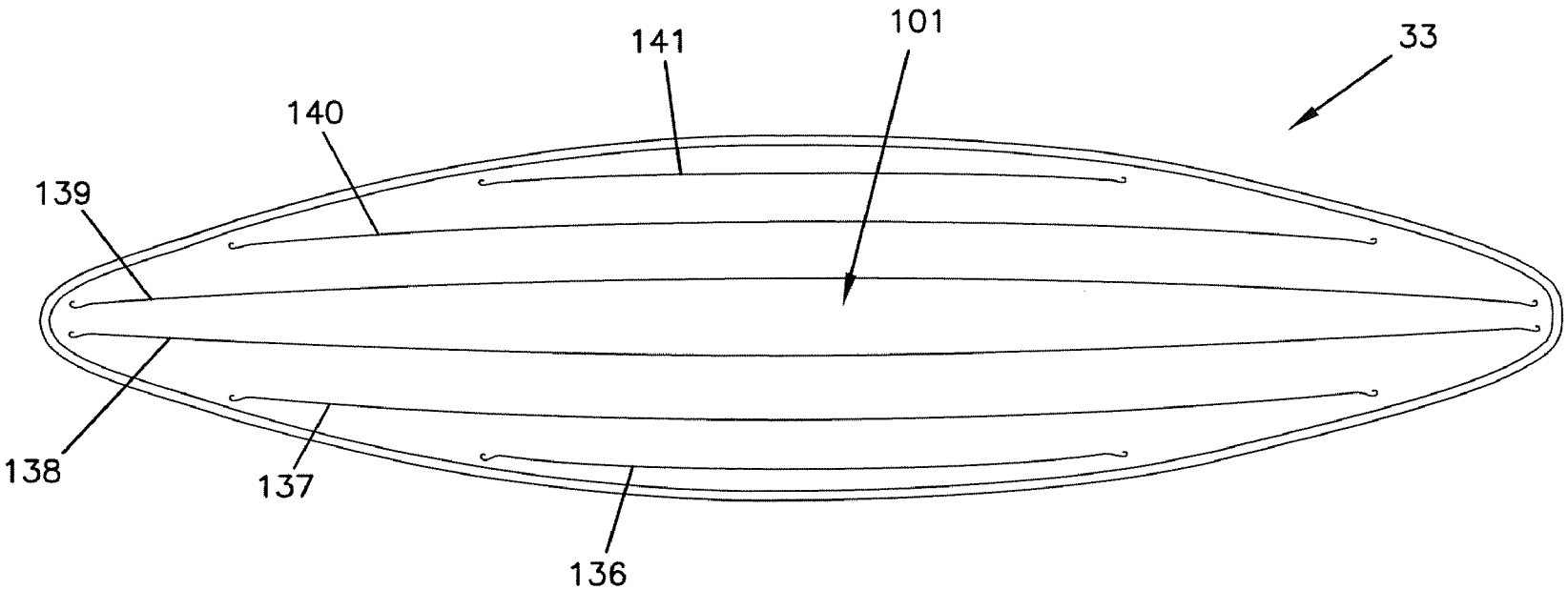
FIG. 11 is a bottom view of a floor cushion incorporating the invention.
Figure 12:
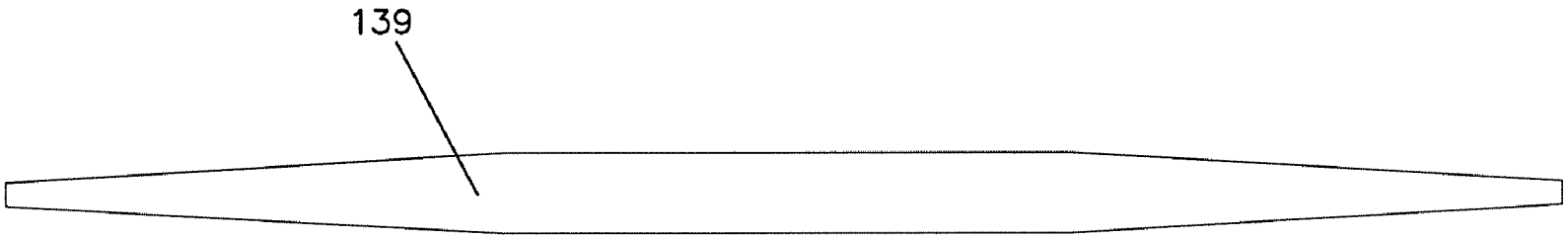
FIG. 12 is a side cross-sectional view of an I-beam baffle incorporating the invention.

The floor cushion 33 is shown more specifically in FIGS. 6–8 and 10–12 and 14–15. As shown in FIG. 8, the cushion 33 is disposed in pocket 46 between the floor 35 and the base 45. As shown in FIG. 7, the cushion 33 includes a bottom surface 101 and a top surface 102 attached by gusset 100. Gusset 100 includes a starboard portion 135 and a port side portion 142. The bottom surface 101, top surface 102, and gusset 100 define inflatable bladder 34. The bottom surface 101 and top surface 102 are also connected by a plurality of I-beam baffles 136, 137, 138, 139, 140, and 141 that extend in a longitudinal direction from the fore section 17 to the aft section 16. In a preferred embodiment, the I-beams do not extend the entire distance from the one end of the floor cushion 33 to the other end. Instead, the I-beams terminate before they reach the peripheral edge of the top surface 102 or bottom surface 101, as shown in FIGS. 10 and 11 that illustrate the top and bottom surfaces, respectively. As a result, air can circulate around the ends of the I-beams within the floor cushion 33. Only one inflation valve, located at aperture 115 is needed to inflate the entire floor cushion. To further facilitate the circulation of air within the floor cushion 33, the I-beams can have openings, although this is not necessary.

Figure 14:
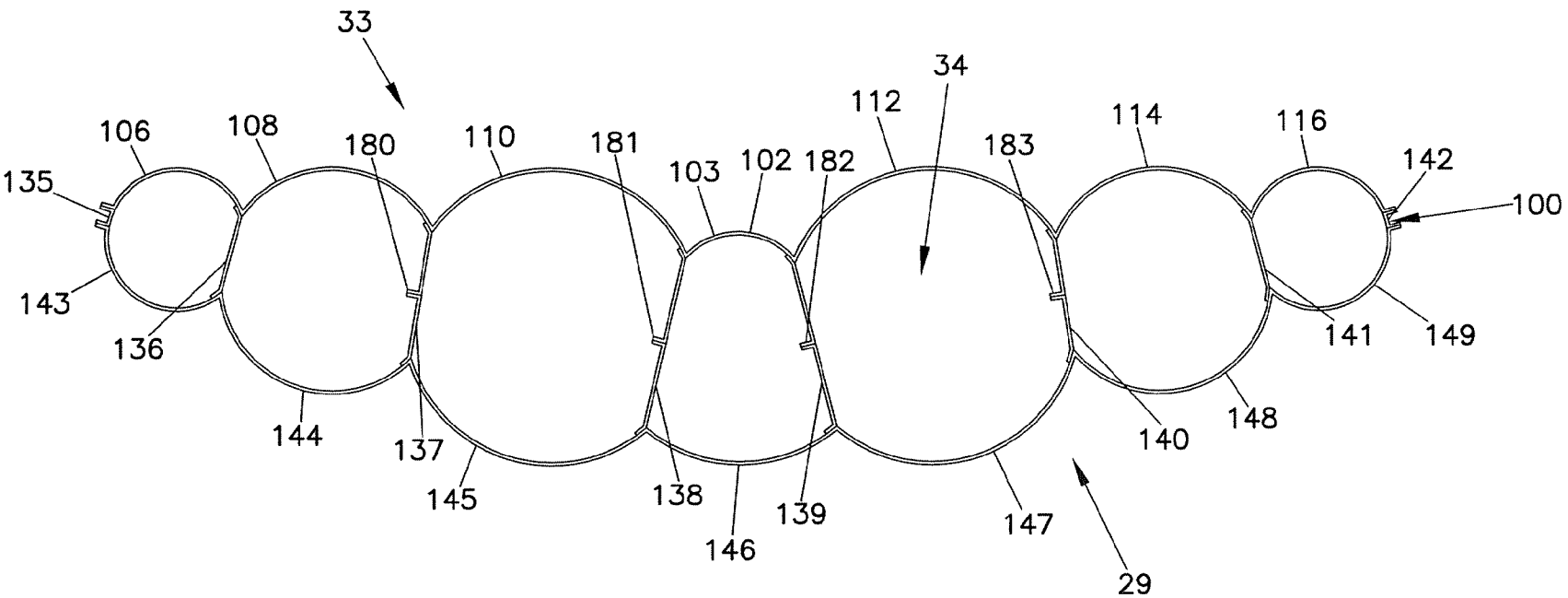
FIG. 14 is a front view of the floor cushion of FIG. 6 taken along line 14—14 of FIG. 6.
Figure 15:
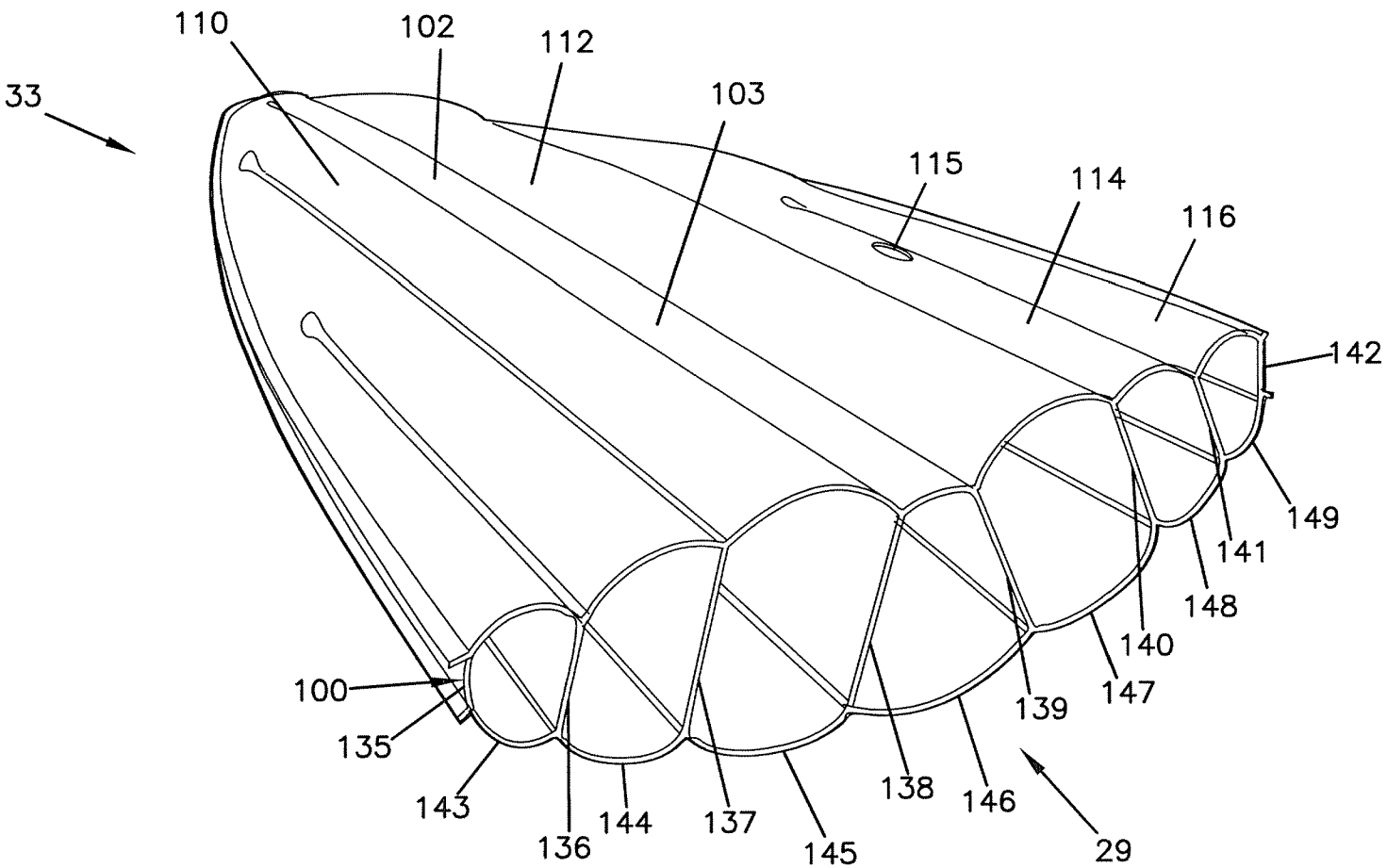
FIG. 15 is a fragmentary isometric view of the floor cushion of FIG. 6 taken along line 14—14 of FIG. 6.

In FIGS. 8 and 14–15, six I-beam baffles are shown. In FIG. 14, seams 180, 181, 182, 183 are shown between the top surface 102 and bottom surface 101 of I-beam baffles 137, 138, 139, and 140 respectively. It is important to note that each of the I-beam baffles can be created with or without seams between top surface 102 and bottom surface 101. I-beam baffles without seams are shown in FIG. 15. Similarly, the invention may also use any number of I-beams and still fall within the scope of the invention. For example, four I-beam baffles and eight I-beam baffles also can produce exemplary hull embodiments when disposed within bladder 34.

FIG. 14 shows a generally arcuate longitudinal cross-sectional shape of the floor cushion 33. The inflatable nature of the floor cushion 33, combined with the novel position of I-beam baffles relative to the top surface 102 and relative to the bottom surface 101 enables bottom surface 101 to maintain a keeled profile. The keeled bottom surface 101, includes several curved sections when the floor cushion 33 is inflated. The area of bottom surface 101 between gusset 135 and baffle 136 forms bottom segment 143. The area of bottom surface 101 between baffle 136 and baffle 137 forms bottom segment 144. The area of bottom surface 101 between baffle 137 and 138 forms bottom segment 145. The area of bottom surface 101 that defines the center segment 146 of the keeled bottom surface 101 is located between baffle 138 and baffle 139. The area of bottom surface 101 between baffle 139 and baffle 140 forms bottom segment 147. The area of bottom surface 101 between baffle 140 and 141 forms bottom segment 148. The area of bottom surface 101 between baffle 141 and gusset 142 forms bottom segment 149.

The top surface 102 is also divided into several curved sections when the floor cushion 33 is inflated. For example, the area of top surface 102 between gusset 135 and baffle 136 forms top segment 106. The area of top surface 102 between baffle 136 and baffle 137 forms top segment 108. The area of top surface 102 between baffle 137 and baffle 138 forms top segment 110. The area of top surface 102 that defines the center 103 of the floor 35 is located between baffle 138 and baffle 139. The area of top surface 102 between baffle 139 and baffle 140 forms top segment 112. The area of top surface 102 between baffle 140 and baffle 141 forms top segment 114. The area of top surface 102 between baffle 141 and gusset 142 forms top segment 116. It is important to note that when floor cushion 33 is not inflated, top surface 102 can be a generally flat surface compared to the inflated profile of floor cushion 33.

The distance between the I beam baffles 138 and 139 is greater near the bottom surface 101 than at the top wall 102 of the floor cushion 33. As shown on FIG. 14, I-beam baffles 138 and 139 are situated at an angle with respect to a horizontal. For example, the distance between I-beam baffles 138 and 139 along segment 103 of top wall 102 is less than the distance between I-beam baffles 138 and 139 along segment 146 of lower section 29. In one embodiment, I-beam baffles 138 and 139 are 10% farther apart along segment 146 than along segment 103. In another embodiment, I-beam baffles 138 and 139 are 25% farther apart along segment 146 than along segment 103. In a preferred embodiment, I-beam baffles 138 and 139 are 50% farther apart along segment 146 than along segment 103. As a result, the bottom segment 146 is pushed outward and downward while the center top segment 103 is held down. This novel configuration of the cushion 33 provides the kayak 10 with improved tracking characteristics while reducing the below waterline drag. Moreover, the top wall 102 has less surface area than the bottom wall 101. In one embodiment, the top wall 102 has at least 2% less surface area than the bottom wall 101. In another embodiment, the top wall 102 has at least 5% less surface area than the bottom wall 101. In a preferred embodiment, the top wall 102 has at least 10% less surface area than the bottom wall 101. This has the effect of creating a keeled lower section 29 of the kayak 10, which more closely resembles the bottom surface of traditional hard shell kayaks. When inflated within the pocket 46, the cushion 33 defines the keeled profile of the shell 29, which is shown in FIGS. 4 and 5.

In a preferred embodiment, top center segment 103 is lower than the adjacent surfaces 106, 108, 110, 112, 114, and 116 of top surface 102. Similarly, bottom center segment 146 is lower than adjacent surfaces 143, 144, 145, 147, 148, and 149. This helps form the keeled hull profile of the kayak 10. This aspect of the invention also has the effect of reducing the below waterline drag by more evenly distributing the user's weight during operation, and reducing the "barge effect" that is common with prior art inflatable kayaks. The "barge effect" occurs when the width of an object essentially plows water in its path. The large displacement of water caused by the "barge effect" can make it difficult to turn.

As shown in FIG. 8, top segment 103, bottom segment 146, and side I-beam baffles 138 and 139 define center compartment 173. Compartments 172 and 174 are each located to the left and right of center compartment 173. The volume of compartments 172 and 174 is generally larger than the volume of center compartment 173. Compartment 171 is defined by top segment 108 bottom segment 144 and I-beam baffles 136 and 137. Compartment 170 is defined by top segment 106 bottom segment 143 I-beam baffle 136 and side gusset 135. Compartment 176 is located between top segment 116 bottom segment 149 I-beam baffle 141 and gusset 142. Compartment 175 is located between top segment 114 bottom segment 148 and I-beam baffles 140 and 141. These compartments are not sealed from each other as discussed previously, so that the floor cushion can be inflated with on valve through aperture 115 shown in FIG. 15.

Aperture 115 is positioned so that a user may inflate floor cushion 33 including compartments 170, 171, 172, 173, 174, 175, 176 through a single aperture. The floor cushion 33 is encased within a pocket 46 that is defined by floor 35 and base 45. Pocket 46, serves as a rigid skin against which the floor cushion 33 can be inflated to form a rigid structure. In one presently preferred embodiment, the floor cushion 33 fabricated of PVC. The cover 39 is preferably fabricated of tarpaulin, that is a reinforced polymer with a mesh fabric such as nylon or polyester. In an alternative embodiment, the cover 39 is fabricated of nylon.

As shown in FIG. 13, a valve 49 for inflation and deflation of the peripheral structure 11 may be located in the aft section 16 of the tube and extend through an opening in the cover 12 on the upper side of the aft section 16. In one preferred embodiment, this 7 is a Boston valve, but any other suitable type of valve can be used. Separate valves 7 and 49 are provided for the two chambers 23 and 25 respectively, as shown in FIG. 13. In a preferred embodiment, each of these valves is located in the upper wall of the peripheral structure 11. The valve 7 may also be covered by a flap, that can be held closed by a variety of fasteners, including hook and loop fasteners, hooks, loops, straps, or buckles.

A shell 26, shown in FIGS. 1, 3, and 5 spans beneath the passenger compartment 18 and extends along the lower and outer sides of the peripheral structure 11 and cover 12. Shell 26 is not shown in the cross-sections views of FIG. 2 and FIG. 8 to simplify the various views. This shell 26 is preferably fabricated of a waterproof material that is much more durable material than the cover 12, and it serves as a protective sheath for the peripheral structure 11 and cover 12. The shell 26 also provides additional support for the floor 35 of the passenger compartment 18. In one embodiment, the shell 26 includes a nylon-reinforced material. In an alternative embodiment, the shell 26 includes a layer of polyester or nylon between two layers of PVC. In another embodiment, the shell 26 includes a layer of polyester or nylon disposed against at least one layer of PVC coating. The layer of PVC coating is preferably at least 0.2 mm thick and provides a waterproof coating for the shell 26. The shell 26 extends to a point about midway up the outer side of the peripheral structure 11 where it is attached to the nylon cover 12 by a peripheral seam 27. The shell 26 is preferably less than 5 mm thick, preferably between 0.25 mm and 2 mm, more preferably between 0.55 mm to 1 mm.

As shown in FIGS. 1–3, a foldable seat 41 is removably mounted in the rear portion of the passenger compartment 18. This seat 41 has a base 42 and a back rest 43 that are hinged together. A strap 44 may be connected between the base 42 and the back rest 43 for adjusting the angle of the back rest 43 relative to the base 42. The seat 41 may be attached to the floor 35 by fasteners on the upper side of the floor 35 and the lower side of the base 42. The fasteners on the floor cushion 33 are preferably in the form of longitudinally extending strips that permit the position of the seat 41 to be adjusted in accordance with the size of the person using the kayak 10.

If desired, the seat 41 can be removed, and the person using the kayak 10 can sit directly on the floor cushion 33 and lean against the peripheral structure 11 at the rear of the passenger compartment 18.

A splash deck 48, shown in FIGS. 1 and 3 is provided toward the front of the passenger compartment 18 to keep water out of the compartment. The splash deck 48 is stitched to cover 12 along the upper inner periphery of peripheral structure 11 and covers the portion of the compartment 18 in front of the seat 41. The splash deck 48 may include one continuous section as shown in FIG. 1 and 3. Alternatively, splash deck 48 may be split into two sections that are joined together along the longitudinal centerline of the boat by a zipper. A raised bead 51 extends along the rear edge of the skirt 48 to prevent water from dripping into the passenger compartment 18 from the skirt 48.

With reference to FIGS. 1 and 3, a tie-down area 56 is provided toward the fore section 17 of the kayak 10 for holding objects in place. The tie-down area 56 includes an elastic cord 57 that is laced back and forth between loops formed by straps 59 stitched intermittently to cover 12. The free ends of the cord 57 come together at lock 61 that permits the cord to be tightened or loosened as desired.

Storage pockets and a map holder may also be mounted on splash deck 48. The pockets can be formed by sheets of mesh that are attached to the splash deck along three sides of each section by binding tape and stitching, with a flap and a Velcro fastener along the fourth side. The map holder may include a clear plastic bag that has a zipper along one edge thereof. The bag is preferably attached to one section of the skirt by D-rings and clips.

As shown on FIGS. 1 and 3, handles 52 may be provided near the fore section 17 and the aft section 16 or alternatively at the sides of the passenger compartment 18, for lifting the kayak 10 into and out of the water, and for carrying it about. Each of these handles consists of a strap 53 of nylon or other suitable material that is stitched to the tube cover 12, and a grip 54 of rubber or other material that is molded onto the strap 53.

During operation and use of the invention, peripheral structure 11 is inserted into cover 12, and floor cushion 33 is tucked into pocket 46 before the peripheral structure 11 and floor cushion 33 are inflated. The peripheral structure 11 is preferably inflated first, and then the floor cushion 33 is inflated inside it. If used, the foldable seat 41 is then installed and adjusted, and the kayak 10 is ready for launching. Alternatively, the foldable seat may already be in position before inflation.

For transportation and storage, the peripheral structure 11 and the floor cushion 33 are deflated, and the kayak 10 is rolled up or folded. If desired, it can be placed in a bag (not shown) that is easily carried by one person. A collapsible paddle, safety equipment (e.g., life vest, helmet and goggles), and a pump can also be stored and carried in the same bag. It is possible, although not necessary to remove the seat 41 when deflating or folding the kayak 10.

The invention has a number of important features and advantages. The kayak 10 is light in weight and is readily transported and stored. Kayak 10 is durable, and the stiffness provided by inflating the peripheral structure 11 against the nylon cover 12 gives the kayak 10 a solid feel and makes it handle unusually well. It is also more buoyant that a molded kayak.

The kayak 10 and floor cushion 33 of the invention may be provided in many different sizes and weights and in many different kayak configurations. Some examples of workable dimensions will be described but are not intended to limit the invention. In one embodiment, the kayak 10 is preferably 50 pounds (19 kg) or less, more preferably 30 pounds (11 kg) or less and most preferably 25 pounds (9 kg) or less. The kayak 10 is at least 6 feet (1.8 m) in length, from the fore section 17 to the aft section 16, preferably at least 7 feet (2.1 m) in length. The kayak is at most 15 feet (4.6 m) in length from the fore section 17 to the aft section 16, preferably less than 12 feet (3.6 m) in length. In one preferred embodiment, kayak 10 is 10 feet, 5 inches (3.2 m) long. The kayak 10 is at least 2 feet (0.6 m) wide from the starboard side 13 to the port side 14, preferably at least 2.5 feet (0.76 m) wide. The kayak is at most 4 feet wide (1.2 m) from the starboard side 13 to the port side 14, preferably at least 3 feet (0.9 m) wide. In one preferred embodiment, kayak 2 feet, 10 inches (0.8 m) wide.

The floor cushion 33 is at least 6 feet (1.8 m) in length, from the fore section 17 to the aft section 16, preferably at least 7 feet (2.1 m) in length. The floor cushion 33 is at most 9 feet (2.7 m) in length from the fore section 17 to the aft section 16, preferably less than 8 feet (2.44 m) in length. In one preferred embodiment, floor cushion 33 is 7 feet, 10 inches (2.4 m) long. The floor cushion 33 is at least 1.5 feet (0.46 m) wide from the starboard side 13 to the port side 14, preferably at least 1.75 feet (0.53 m) wide. The floor cushion 33 is at most 2.5 feet wide (0.76 m) from the starboard side 13 to the port side 14, preferably at least 2.25 feet (0.69 m) wide. In one preferred embodiment, floor cushion 33 is 1 foot, 9 inches (0.53 m) wide. Although the present invention is illustrated for a touring kayak, it is also usable in several different kayak configurations, including a two person touring kayak, sit-on-top kayak, self bailing inflatable kayak, inflatable canoe, and various inflatable boats.

The above specification, examples and data provide a complete description of the configuration and use of the preferred embodiments of the invention. Since many embodiments of the invention can be made without departing from the spirit and scope of the invention, the invention resides in the claims hereinafter appended which are not intended to be limited by the disclosures of any of the preferred embodiment examples illustrated herein.

We claim:

1. An inflatable kayak comprising:

an inflatable peripheral structure defining at least one buoyancy chamber having elongated side sections that come together at a fore section and a aft section to form a passenger compartment, an inflatable floor cushion supporting a floor of the passenger compartment, the floor cushion including a top wall, a bottom wall, and at least one side gusset, wherein the surface area of the top wall is less than the surface area of the bottom wall, and, a plurality of elongated, I-beam baffles extending between the top wall and the bottom wall, each I-beam baffle having a midpoint, between the fore section and aft section, and an end, wherein the height of at least one I-beams baffle measured from the junction of the top wall to the junction of the bottom wall is greater at the midpoint of the baffle than at the end of the baffle.

2. The inflatable kayak of claim 1, wherein the distance between at least two I-beam baffles along the top wall is less than the distance between the same two I-beam baffles along the bottom wall.

3. The inflatable kayak of claim 2, wherein the surface area of the top wall is at least 5% less than the surface area of the bottom wall.

4. The inflatable kayak of claim 3 wherein the buoyancy chamber of the peripheral structure includes a first compartment and a second compartment disposed concentrically around the first compartment.

5. The inflatable kayak of claim 4, further comprising a cover of flexible material that is less elastic than the material of the peripheral structure and floor cushion, wherein the cover encases the peripheral structure and inflatable floor cushion, forming a substantially inelastic skin against which the peripheral structure and floor cushion can be inflated to form a structure that is more rigid than the peripheral structure and floor cushion.

6. The inflatable kayak of claim 5, further comprising a shell spanning beneath the passenger compartment and extending along the lower and outer sides of the peripheral structure and cover to further support the floor cushion and protect the tube and cover.

7. The inflatable kayak of claim 6 wherein the shell that spans beneath the passenger compartment comprises a layer of nylon disposed between two layers of PVC.

8. The inflatable kayak of claim 7 including a foldable seat mounted in the passenger compartment.

9. The inflatable kayak of claim 8 including a splash deck of flexible material attached to the cover and extending between the side sections of the tube over the forward portion of the passenger compartment.

10. The inflatable kayak of claim 9, wherein the kayak weighs less than 50 pounds (18.7 kg).

11. The inflatable kayak of claim 10, wherein the kayak is between 6 feet (1.8 m) and 15 feet (4.6 m) long from the fore section to the aft section.

12. The inflatable kayak of claim 4, wherein the first compartment contains fluid that is isolated from the second compartment.

13. The inflatable kayak of claim 2, wherein the distance between at least two I-beam baffles along the bottom wall is at least 10% greater than the distance between the two I-beam baffles along the top wall.

14. The inflatable kayak of claim 2, wherein the floor cushion includes a single aperture of inflating the floor cushion.

15. The inflatable kayak of claim 1, wherein the floor cushion is between 6 feet (1.8 m) and 9 feet (2.7 m) in length from the fore section to the aft section.

16. The inflatable kayak of claim 1, wherein the plurality of elongated I-beam baffles includes at least 4 I-beam baffles.

17. An inflatable floor cushion of a kayak comprising:

an inflatable floor cushion including a top wall, a bottom wall, and at least one gusset joining the top wall and bottom wall to define a chamber, a plurality of elongated I-beam baffles within the cushion, each I-beam baffle including a midpoint, between the fore section and aft section, and an end, wherein the distance between at least two I-beam baffles along the top wall is less than the distance between the same two I-beam baffles along the bottom wall.

18. The cushion of claim 17, wherein the surface area of the top wall is at least 5% less than the surface area of the bottom wall.

19. The cushion of claim 18, wherein each I-beam baffle includes a midpoint and an end, wherein the height of at least one I-beam baffle measured from the junction of the top wall to the junction of the bottom wall is greater at the midpoint of the baffle than at the end of the baffle.

20. An inflatable kayak comprising:

an inflatable peripheral structure defining at least one buoyancy chamber having elongated side sections that come together at a fore section and a aft section to form a passenger compartment, wherein the buoyancy chamber of the peripheral structure includes a first compartment and a second compartment disposed concentrically around the first compartment, an inflatable floor cushion, wherein the floor cushion supports a floor of the passenger compartment and includes a top wall, a bottom wall, and at least one side gusset, wherein the surface area of the top wall is at least 5% less than the surface area of the bottom wall, a plurality of elongated, I-beam baffles extending in the longitudinal direction from the fore section of the kayak to the aft section of the kayak, between the top wall and the bottom wall, each I-beam baffle having a midpoint, between the fore section and aft section, and an end, wherein the height of at least one I-beam baffle measured from the junction of the top wall to the junction of the bottom wall is greater at the midpoint of the baffle than at the end of the baffle, wherein the distance between at least two I-beam baffles along the top wall is less than the distance between the same two I-beam baffles along the bottom wall, a cover of flexible material that is less elastic than the material of the peripheral structure and floor cushion, wherein the cover encases the peripheral structure and inflatable floor cushion, forming a substantially inelastic skin against which the peripheral structure and floor cushion can be inflated to form a structure that is more rigid than the peripheral structure and floor cushion, and a shell spanning beneath the passenger compartment and extending along the lower and outer sides of the peripheral structure and cover to further support the floor cushion and protect the tube and cover.

* * * * *